US007218872B2

(12) United States Patent
Shimomura

(10) Patent No.: US 7,218,872 B2
(45) Date of Patent: May 15, 2007

(54) IMAGE FORMING APPARATUS

(75) Inventor: Tatsuhiko Shimomura, Tokyo (JP)

(73) Assignee: Oki Data Corporation, Tokyo (JP)

( * ) Notice: Subject to any disclaimer, the term of this patent is extended or adjusted under 35 U.S.C. 154(b) by 191 days.

(21) Appl. No.: 11/131,716

(22) Filed: May 18, 2005

(65) Prior Publication Data

US 2005/0260007 A1 Nov. 24, 2005

(30) Foreign Application Priority Data

May 20, 2004 (JP) ..... 2004-150185

(51) Int. Cl.
*G03G 15/06* (2006.01)
*G03G 15/00* (2006.01)

(52) U.S. Cl. ..... 399/55; 399/44

(58) Field of Classification Search ..... 399/44, 399/51, 53, 55, 281, 279
See application file for complete search history.

(56) References Cited

U.S. PATENT DOCUMENTS

2005/0158061 A1* 7/2005 Do ..... 399/44
2005/0158064 A1* 7/2005 Yoshida ..... 399/49

FOREIGN PATENT DOCUMENTS

JP 7-134477 A 5/1995
JP 2004-170789 A 6/2004

* cited by examiner

*Primary Examiner*—Hoang Ngo
(74) *Attorney, Agent, or Firm*—Akin Gump Strauss Hauer & Feld LLP

(57) ABSTRACT

To correct a bias voltage of each roller upon estimating a toner potential precisely even where toner's characteristics change due to, e.g., changes of environmental condition, changes over time, supplements of the toner, replacement of an EP cartridge, or the like, on an image forming apparatus according to this invention, the toner potential is estimated upon measuring a DB current in a prescribed period from a time that a development starting point on the developing roller starts development to a time that the development starting point comes in contact with a toner supplying roller. Alternatively, where the measured DB current is equal to or less than a fixed amount, a period for a warming-up processing is extended. Alternatively, where the toner is judged as supplemented upon detection of the remaining toner amount, a prescribed warming-up processing is made before the measurement for the DB current. Further alternatively, where the toner is judged as supplemented upon the detection of the remaining toner amount, a bias voltage of each roller set upon corrected based on the toner potential estimated based on the DB current is further corrected.

12 Claims, 17 Drawing Sheets

FLOW CHART SHOWING OPERATION OF IMAGE FORMING APPARATUS ACCORDING TO FIRST EMBODIMENT

VIEW SHOWING STRUCTURE OF CONTROL SYSTEM ACCORDING TO FIRST EMBODIMENT AND SECOND EMBODIMENT

VIEW SHOWING STRUCTURE OF IMAGE FORMING APPARATUS ACCORDING TO EMBODIEMENTS

EXAMPLE OF STRUCTURE OF CURRENT DETECTING UNIT ACCORDING TO EMBODIMENTS

VIEW SHOWING RELATION BETWEEN BIAS VOLTAGE AND TONER VOLTAGE ON EACH UNIT

VIEW SHOWING RELATION BETWEEN DB CURRENT VALUE AND TONER POTENTIAL ACCORDING TO EMBODIMENTS

WAVE FORMS OF PHOTOSENSITIVE DRUM SURFACE POTENTIAL AND DB CURRENT ACCORDING TO EMBODIMENTS

ILLUSTRATION OF RELATION BETWEEN EXPOSURE ENERGY AND PHOTOSENSITIVE DRUM REMAINING POTENTIAL

VIEW SHOWING RELATION BETWEEN DB CURRENT VALUE AND TONER POTENTIAL ACCORDING TO EMBODIMENTS

TIME CHART OF DB CURRENT MEASURMENT ACCORDING TO EMBODIMENS

FLOW CHART SHOWING OPERATION OF IMAGE FORMING APPARATUS ACCORDING TO FIRST EMBODIMENT

FLOW CHART SHOWING OPERATION OF IMAGE FORMING APPARATUS ACCORDING TO SECOND EMBODIMENT

VIEW SHOWING CONTROL SYSTEM ACCORDING TO THIRD EMBODIMENT AND FOURTH EMBODIMENT

VIEW SHOWING STUCTURE OF IMAGE FORMING APPARATUS ACCORDING TO THIRD EMBODIMENT AND FOURTH EMBODIMENT

STRUCTURE OF AGITATOR ACCORDING TO THIRD EMBODIMENT AND FOURTH EMBODIMENT (a) in a case of the large toner amount (b) in a case of the small toner amount OUTPUT SIGNAL OF PHOTOINTERRUPTER ACCORDING TO THIRD EMBODIMENT AND FOURTH EMBODIMENT FLOW CHART SHOWING OPERATION OF IMAGE FORMING APPARATUS ACCORDING TO THIRD EMBODIMENT FLOW CHART SHOWING OPERATION OF IMAGE FORMING APPARATUS ACCORDING TO FOURTH EMBODIMENT

VIEW SHOWING STRUCTURE OF CONVENTIONAL IMAGE FORMING APPARATUS

IMAGE FORMING APPARATUS

BACKGROUND OF THE INVENTION

1. Field of the Invention

This invention relates to an image forming apparatus such as, e.g., a printer, a facsimile machine, an electrophotographic apparatus, a photocopier, or the like.

2. Description of Related Art

As shown in FIG. 18, an image forming apparatus is generally composed of a photosensitive drum 1 formed with an electrostatic latent image on a surface thereof, a developing roller 2 for shifting a toner 9 serving as a developer onto the photosensitive drum 1, a toner supplying roller 3 for shifting the toner 9 supplied arbitrarily from a toner cartridge 12 to the developing roller 2, a toner blade 10 for regulating a thickness of a toner layer shifted to the photosensitive drum 1, an LED (Light Emitting Diode) head 26 for forming the electrostatic latent image on the photosensitive drum 1, a charging roller 4 for rendering the surface of the photosensitive drum 1 have a prescribed electric potential, a transfer roller 5 for transferring the toner attached on the electrostatic latent image formed on the photosensitive drum 1 to a printing medium 11, and a cleaning blade 7 for removing the toner remaining after transferred on the surface of the photosensitive drum 1.

In consideration of maintainability, furthermore, it is general that the developing roller 2, the toner supplying roller 3, the toner blade 10, and the toner cartridge 12 are structured as an EP (Environmental Photocell) cartridge 13 to be replaceable as a united body.

As shown in FIG. 18, negative bias voltages, i.e., Vg, Vs, and Ve, are respectively applied to the developing roller 2, the toner supplying roller 3, and the charging roller 4 while a positive bias voltage is applied to the transfer roller 5. It is to be noted that since the subsequent description mostly explains the negative bias voltages applied to the developing roller 2, the toner supplying roller 3, and the charging roller 4, these bias voltages are to be explained as absolute value voltages with respect to the zero potential as a reference for the sake of convenience. For example, in a case of "the high potential," the potential is more negative.

With the above described conventional image forming apparatus, the total potential amount of the toner per unit area, hereinafter referred to as a toner potential, may exceed an appropriate range with respect to a surface potential of the photosensitive drum 1, where the toner, the toner supplying roller 3, the developing roller 2, or the like changes charging property thereof according to an environmental condition such as, e.g., temperature and humidity of the toner cartridge 12, thereby greatly changing the toner amount per unit area attached near to the developing roller 2 even under application of the same bias voltage.

For example, where becoming superior in the charging property upon the change in the environmental condition, the toner is attached more to the developing roller 2, thereby heightening comparatively the potential thereof near the developing roller 2, and raising a problem that irregular printing may occur in causation of attachment of the toner to the photosensitive drum 1 at an unexposed area at which a printing is not implemented due to the high toner potential. Conversely, where becoming inferior in the charging property for the change in the environmental condition, the toner is attached less to the developing roller 2, thereby lowering comparatively the potential thereof near the developing roller 2, and raising a problem that toner concentration lowers, thereby causing the printing to become blurred.

With the conventional image forming apparatus, to cope with the change in the toner potential due to the change in the environmental condition as described above, the appropriate bias voltage of the toner supplying roller 2 corresponding to each environmental condition is previously determined according to, e.g., an experiment or the like, and the bias voltage is set at a time of the printing upon retrieving the bias voltage corresponding to the environmental condition detected with a temperature and humidity sensor or the like (see, e.g., Japanese Patent Application Publication No. 7-134477).

However, with the above described conventional image forming apparatus, there may raise a problem that where the temperature and humidity sensor is not placed at the appropriate position within the EP cartridge 13, differenced may occur as detection errors of the environmental condition, so that the appropriate bias voltage cannot be set, while where the charging property changes according to change over time or to each replacement of the toner cartridge 12, the bias voltage is set with the same setting table, so that the appropriate bias voltage cannot be set as well.

SUMMARY OF THE INVENTION

To solve the above described problems, an image forming apparatus according to this invention has an image carrier charged upon application of a first voltage; an exposure unit for forming an electrostatic latent image on said charged image carrier; a developing member for developing, upon application of a second voltage, a developer corresponding to said electrostatic latent image formed on said image carrier; a developer supplying member for supplying said developer to said developing member, upon application of a third voltage; a current detecting unit for measuring an amount of current flowing through said developing member; a development controller for rendering, upon applying said voltage, each member implement warming-up operation for a first prescribed period after rendering said expose unit in a substantially suspended status, for rendering said exposure unit implement development operation for a second prescribed period after said warming-up operation; and a voltage setting unit for adjusting said voltage to be applied to at least one of said members based on said current amount detected with said current detecting unit during said development operation.

As described above, since the image forming apparatus according to this invention has the development controller, in which the development controller renders the exposure unit make the development operation for the prescribed period after applying the voltage to each member upon suspending the operation of the exposure unit for the prescribed period, so the voltage to be applied to at least one of the members as to be settable based on a current amount detected with the current detecting unit during the development operation. Therefore, the above voltage to be applied can be set more precisely, so that the printing can be prevented certainly from getting soiled as well as from becoming blurred.

BRIEF DESCRIPTION OF THE DRAWINGS

This invention may take physical form in certain parts and arrangements of parts, a preferred embodiment and method of which will be described in detail in this specification and illustrated in the accompanying drawings which form a part hereof, and wherein.

DETAILED DESCRIPTION OF PREFERRED EMBODIMENTS OF THE INVENTION

Figure 1:
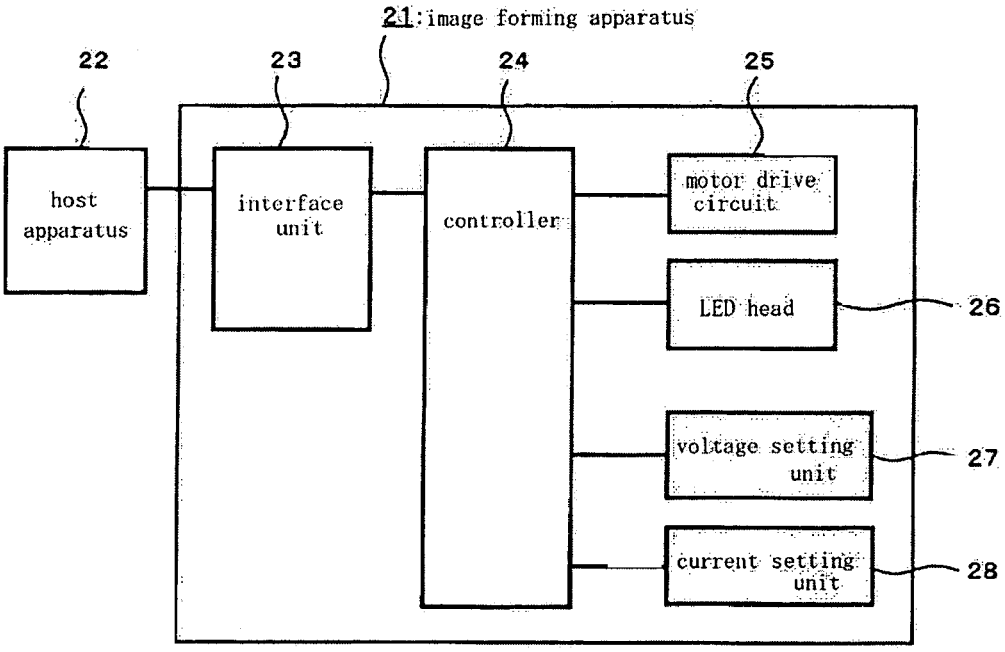
FIG. 1 is a view showing a structure of a control system according to the first embodiment and the second embodiment.

Hereinafter, embodiments according to this invention will be described in reference to drawings. It is to be noted that the same numerals are assigned to the common elements in the drawings.

First Embodiment

An image forming apparatus according to the first embodiment estimates a toner potential upon measuring an electric current, referred to as a DB current, flowing to a developing roller, at a time of printing operation within a certain range from when a development starting point on the developing roller starts development to when the development starting point comes in contact with a toner supplying roller.

(Structure of Control System)

FIG. 1 is a view showing a structure of a control system of the image forming apparatus according to the first embodiment. As shown in FIG. 1, an image forming apparatus 21 according to the first embodiment is composed of an interface unit 23 for receiving printing data from a host apparatus 221; a controlling unit 24 for controlling the printing or drive of a medium conveyance motor based on an output result with a current measuring unit 28 to be described hereinafter or with a medium detecting sensor, not shown; a motor drive circuit 25 for driving rotatably a medium conveyance route, each roller, a photosensitive drum 1, etc. upon driving rotatably a motor, not shown, based on control with the controlling unit 24; a LED head 26 for changing images, letters, etc. defined as printing data transmitted from the host apparatus into an electrostatic latent images on the photosensitive drum; a voltage setting unit 27 for setting a bias voltage of each roller; and the current measuring unit 28 for measuring the DB current defined as a current flowing through a toner supplying roller 3, and these are connected as shown in FIG. 1.

(Structure of Image Forming Apparatus)

Figure 2:
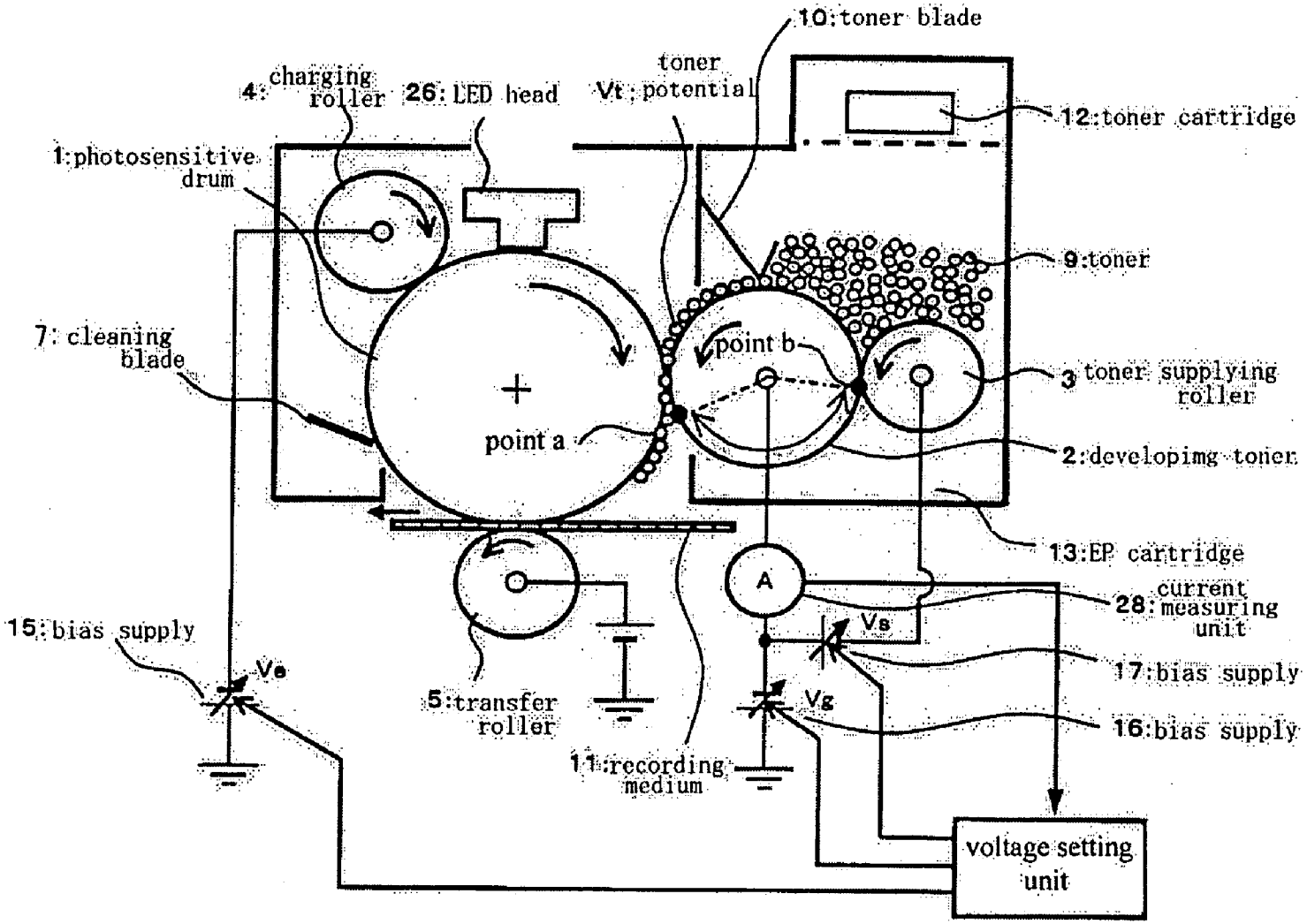
FIG. 2 is a view showing a structure of an image forming apparatus according to embodiments.

The image forming apparatus according to the first embodiment is, as shown in FIG. 2, composed of a photosensitive drum 1 formed with an electrostatic latent image on a surface thereof, a developing roller 2 for operating development upon shifting a toner 9 correspondingly to the electrostatic latent image formed on the photosensitive drum 1; a toner supplying roller 3 for shifting the toner 9 supplied arbitrarily from a toner cartridge 12 to the developing roller 2; a toner blade 10 for forming a toner layer of a prescribed thickness on the developing roller 2; a LED head 26 for forming the electrostatic latent image on the photosensitive drum 1, a charging roller 4 for rendering the surface of the photosensitive drum 1 have a prescribed potential; a transfer roller 5 for transferring the toner attached onto the electrostatic latent image formed on the photosensitive drum to a printing medium; a cleaning blade 7 for cleaning the toner remaining after transferred on the surface of the photosensitive drum 1; and a fusing unit, not shown, for fusing the toner on the recording medium.

Furthermore, the image forming apparatus according to the first embodiment is composed of a current measuring unit 28 for detecting an amount of a current flowing into the developing roller 2; a bias supply 15 for the charging roller 4; a bias supply 16 for the developing roller 2; a bias supply 17 for the toner supplying roller 3; and a voltage setting unit 27 for setting each bias voltage based on a detected amount with the current measuring unit 28, and these are connected as shown in FIG. 2.

(Structure of Current Measuring Unit)

Figure 3:
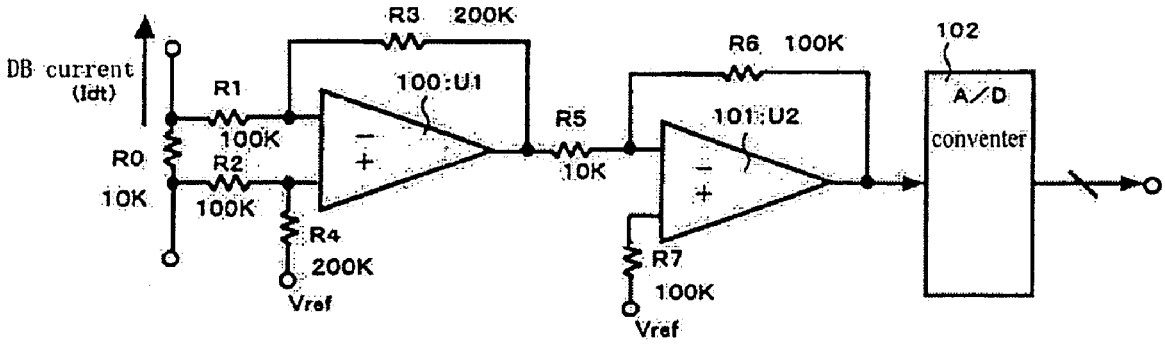
FIG. 3 is a view showing an example of a structure of a current detecting unit according to embodiments.

Herein, as a measuring method of the current measuring unit for measuring the DB current, it is only necessary to connect in series resistance R0 of a comparatively low resistance, i.e., generally approximate 10 KΩ, between an output of the bias supply 16 for the developing roller 2 and the developing roller 2 so the bias voltage of the developing roller not to get affected, thereby amplifying differentially, as shown in FIG. 3, a voltage of each end of the resistance R0 with a differential amplifier circuit having high impedance U1 composed of an operational amplifier 100 and peripheral resistances R1 to R4, thereby amplifying and converting this output with a converting amplifier circuit U2, composed of an operational amplifier 101 and peripheral resistances R5 to R7, thereby converting this output voltage into a digital signal with an A/D converter 102, thereby transmitting the digital signal to the controlling unit 24. An output signal of, e.g., a differential amplification circuit or the like may be, of course, remained as an analog signal, and may be connected to an input of an analog circuit for controlling a voltage of each bias supply. A Vref terminal is desirably set to have a constant voltage of approximate 2.5 V.

It is to be noted that a current detector circuit in FIG. 3 is structured so that where, e.g., a current of 1 μA flows, a voltage at each end of 10 KΩ is set to 10 mV, and the voltage of 10 mV is then doubled with the differential amplifier U1 and thereafter decupled with the inverting amplifier U2, thereby being converting into a voltage of 200 m V On returning to FIG. 2 again, negative bias voltages, i.e., Vg, Vs, Ve are, as shown in FIG. 2, respectively applied to the developing roller 2, the toner supplying roller 3, the charging roller 4, while positive bias voltages are respectively applied to the transfer roller 5 and the cleaning blade 7. Of course, such a structure is applicable that the above negative and positive voltages are exchanged each other.

(General Printing Operation)

With the above described structure, the image forming apparatus according to the first embodiment implements printing operation as described hereinafter. That is, the toner 9 supplied as needed from the toner cartridge 12 is conveyed with the toner supplying roller 3 to the developing roller 2, thereby being shifted to the developing roller 2 with a toner thickness uniformed with the toner blade 10. Subsequently, the LED head 26 generates the electrostatic latent image on the photosensitive drum 1 (in this state, a potential is generally decreased at positions corresponding to images, letters, or the like), and the toner 9 is attached onto the electrostatic latent image, thereby being transferred to the printing medium 11 between the photosensitive drum 1 and the transfer roller 5, and then the printing is operated upon fusing the toner with the fusing unit, not shown, and subsequently the photosensitive drum 1 is cleaned up upon scratched off the toner remaining on the photosensitive toner 1 with the cleaning blade 7.

A bias voltage to be applied to each roller to shift the toner 9 in order is explained next in reference with FIG. 4. First, the boas supply 16 sets a surface potential of the developing roller 2 to Vg, and further the bias supply 17 applies a bias voltage of Vs to the toner 9 to attach the toner 9 onto the developing roller 2. Because a variation exists in the thickness of the toner even although the toner blade 10 uniforms approximately the thickness of the toner 9 attached onto the developing roller 2 in general, the toner potential is distributed, as indicated by $\phi$ in FIG. 4, in a manner of an approximate normal distribution with an average value of Vt as a center.

Figure 4:
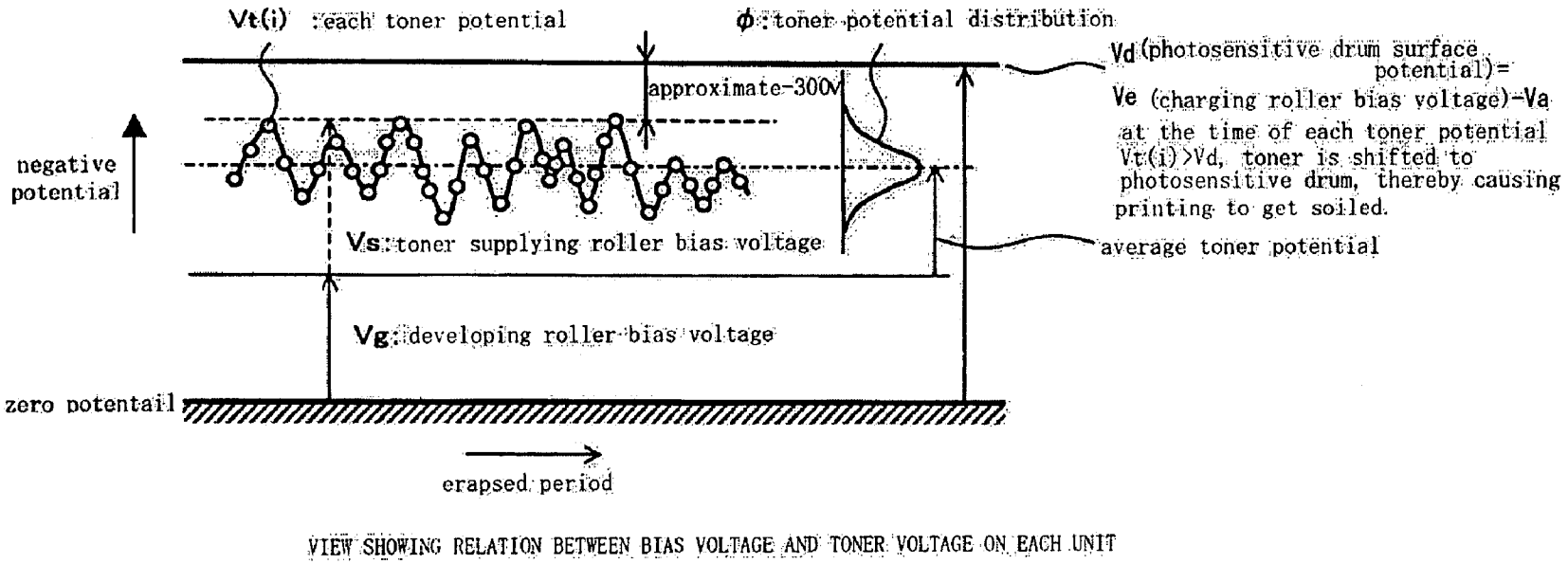
FIG. 4 is a view showing a relation between a bias voltage and a toner voltage at each unit.

In a case of no images or letters to be printed, since the LED head 26 dos not generate any electrostatic latent image on the photosensitive drum 1, the surface potential of the photosensitive drum 1, hereinafter referred to as a photosensitive drum surface potential, is set to a fixed potential of Vd as shown in FIG. 4. The photosensitive drum surface potential Vd is set to more than toner potential Vt so that the toner 9 is not attached to the photosensitive drum 1 from the developing roller 2. Herein, since an air gap or the like between the charging roller 4 and the photosensitive drum 1 causes the potential difference, i.e., a sparkover voltage such as changeable according to an air gap or a shape but generally of approximate 500 V, in the photosensitive surface potential Vd, where the bias voltage of the charging roller is set to Ve while the potential difference is set to $V_a$, the following expression is satisfied.

$$Vd=Ve-V_a \qquad \text{Expression 1}$$

Thus, the bias voltage Ve of the charging roller 4 is set in consideration of the potential difference.

Where the images or letters to be developed exist, the LED head 26 generates the electrostatic latent image so as to decrease the photosensitive drum surface potential Vd, so that the toner potential Vt becomes higher at the portions corresponding to the images or letters, and thus the toner is attached to the photosensitive drum 1. The toner 9 is transferred to the recording medium 11 with the transfer roller 5 biased to a positive potential, thereby being fused with the fusing unit, not shown.

(Relation Between DB Current and Toner Potential)

On the image forming apparatus according to the first embodiment, in which the printing is operated as described above, results are shown in FIG. 5, in which the toner potential near the developing roller 2 and the DB current amount equal to the current to be supplied to the developing roller 2 are measured under the condition that the amount of the toner formed as layered on the developing roller 2 is changed at the time of a solid printing, without regard to timing for measurement.

It is to be noted that the toner amount on the developing roller 2 is changed upon changing the bias voltage Vg of the developing roller 2 or the bias voltage Vs of the toner supplying roller 3 while the toner potential near the developing roller 2 is measured with a surface potential measuring device with use of a Kelvin method, i.e., a vibrating capacitor method.

Figure 5:
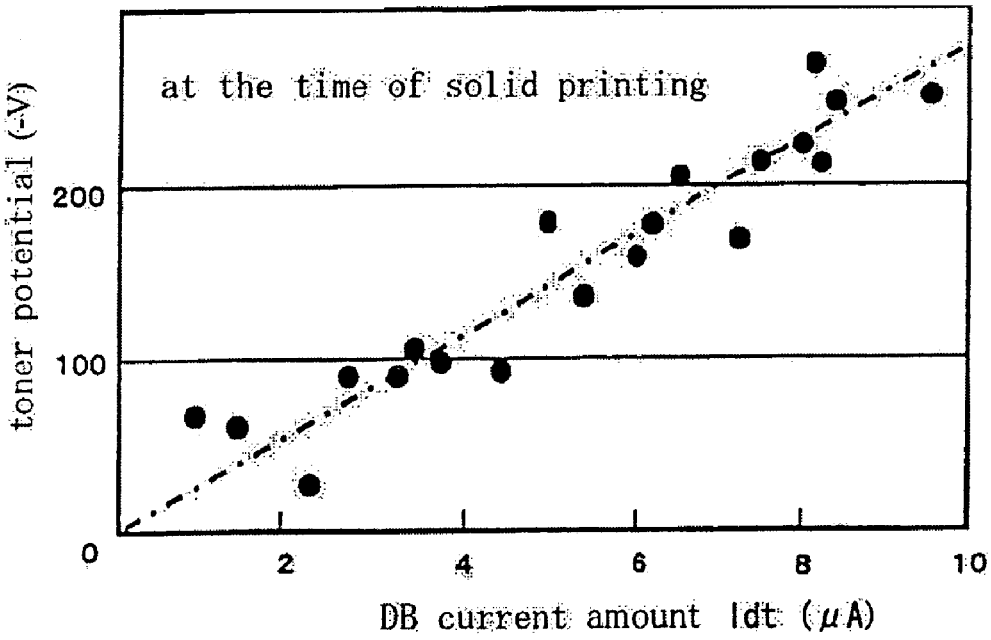
FIG. 5 is a view showing relation between a DB current value and a toner potential according to each embodiment.

It is found, as shown FIG. 5, that a relation exists between the DB current amount and the toner potential, in which the DB current is greater when the toner potential is higher. This is because that when the toner potential increases, the amount of the toner shifting to the photosensitive drum 1 increases, and thus the DB current increases.

With use of the above relation, for example, the toner potential can be estimated upon estimating the toner potential near the developing roller 2 in using the DB current amount by collinearly approximating a relation between the DB current amount and the toner potential, as shown by a dashed line in FIG. 5. However, since there is a variation in the measurement on the relation between the DB current amount and the toner potential as shown in FIG. 5, an error occurs in the measured toner potential.

Figure 6:
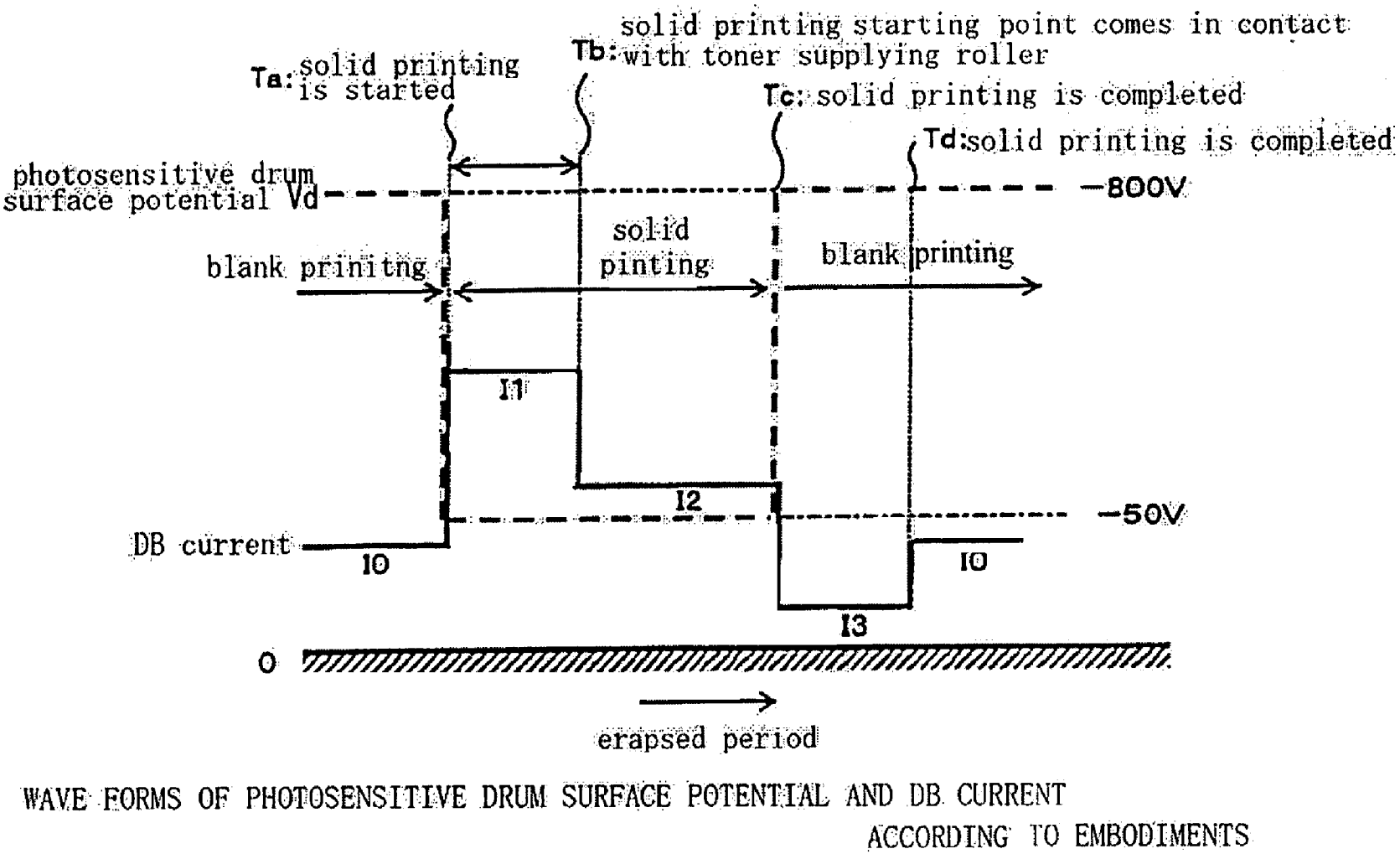
FIG. 6 is a view showing waveforms of a surface potential of a photosensitive drum and a DB current according to embodiments.

In the meantime, the DB current expressed by a full line changes as shown in FIG. 6, where the printing is operated in the order of an unexposed printing, i.e., a blank printing in such a condition that each voltage is supplied to the charging roller, the developing roller, and the toner supplying roller while each roller and the photosensitive drum are rotationally operated but the exposure operation is not implemented with the LED head so the toner is not attached onto the photosensitive drum, a full-page exposed printing, i.e., a solid printing in such a condition that each voltage is supplied to the charging roller, the developing roller, and the toner supplying roller while each roller and the photosensitive drum are rotationally operated to expose an entire surface of the photosensitive drum with the LED head and to develop thereafter the toner image on the photosensitive drum, and the blank printing under the condition of the fixed voltage applied to the developing roller 2 and the toner supplying roller 3.

It is to be noted that a dotted line expresses the photosensitive drum surface potential Vd.

That is, the DB current is set to I0 in a time period from when the blank printing is operated to when the solid printing is operated in timing Ta, and then the high current of I1 flows stably in a time period from when the solid printing is started in the timing Ta to when a point a shown in FIG. 2 at which almost no toner 9 remains on the developing roller 2 after the toner 9 on the developing roller 2 starts be developed on the photosensitive drum 1, comes in contact with the toner supplying roller 3, as expressed by point b in FIG. 2 and timing Tb in FIG. 6. However, when the point a reaches the point b thereafter, new toner is attached to the developing roller 2, so that the DB current decreases to I2 since the amount of the attached new toner is balanced by the amount of the toner shifted to the photosensitive drum 1.

When the solid printing is completed in timing Tc, the DB current decrease to I3 since the toner are not shifted any more from the developing roller 2 to the photosensitive drum 1, and thereafter the DB current returns to I0 since the solid printing does not have an effect on the DB current any more in timing Td when a point of the developing roller 2, at which the solid printing is completed, reaches the toner supplying roller.

The DB current thus changes greatly between the I1 and I2 as described above where the DB current during the solid printing is measured without regard to the timing for measurement. On the image forming apparatus according to the first embodiment, therefore, a period of the solid printing during which the DB current is measured is rendered within a period shorter than a period during which the point a on the developing roller 2 moves to the position of the point b.

The reason why the solid printing is chosen, as described above, for the DB current measurement is that the toner potential is more precisely measured with the DB current at the time of the solid printing than the unexposed printing, or the like since in a case of the full-page exposed printing, almost all of the toner 9 near the developing roller 2 shifts to the photosensitive drum 1 to hardly remain between the toner supplying roller 3 and the developing roller 2, thereby increasing the DB current, compared with a case of, e.g., the unexposed printing where the toner 9 hardly shifts to the photosensitive drum 1 to exist plenty between the developing roller 2 and the photosensitive drum 1.

Figure 7:
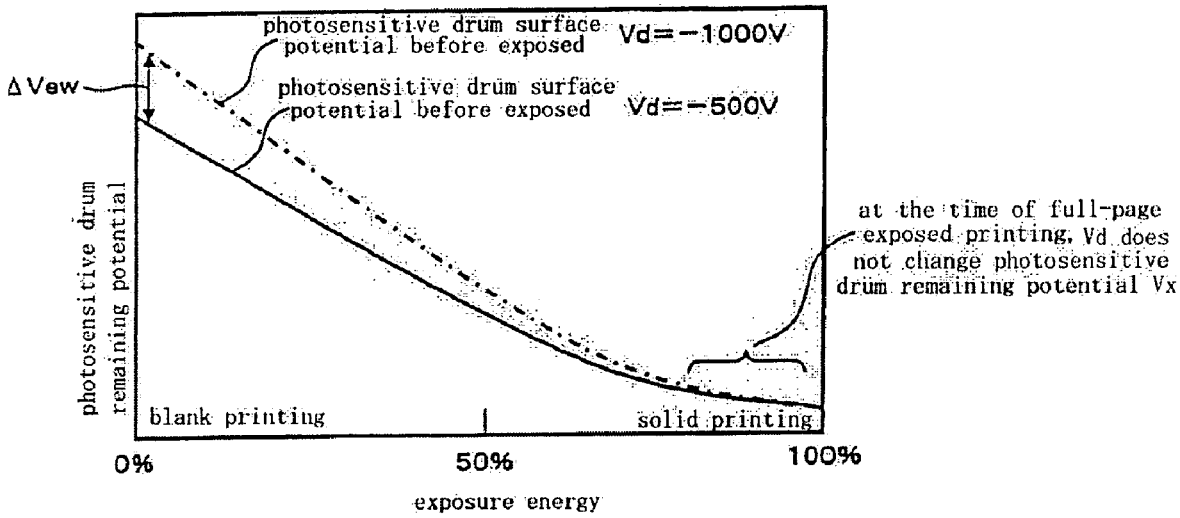
FIG. 7 is an illustration of a relation between exposure energy and a potential remaining on a photosensitive drum.

As shown in FIG. 7, furthermore, where the photosensitive drum surface potential Vd before exposed changes between −1000V and −500V, in a case of the blank printing (left side in FIG. 7), the photosensitive surface potential after exposed, i.e., a photosensitive drum remaining potential Vx, changes by a value of ΔVew, thereby changing the DB current as the result. On the other hand, in a case of the solid printing (right side in FIG. 7), even where the photosensitive drum surface potential Vd changes, the photosensitive drum remaining potential Vx does not change, so that the DB current does not change as the result. From this point of view also, the solid printing is more suitable for the stable DB current measurement.

Furthermore, where the solid printing is made on only one part of printing area, abrasion occurs at only that part due to wear at the photosensitive drum or to scratch with the cleaning member, and deterioration proceeds at only that part, so that an apparatus life is undesirably shortened. From this point of view also, the solid printing is more suitable.

(Operation of Toner Potential Estimation)

Figure 8:
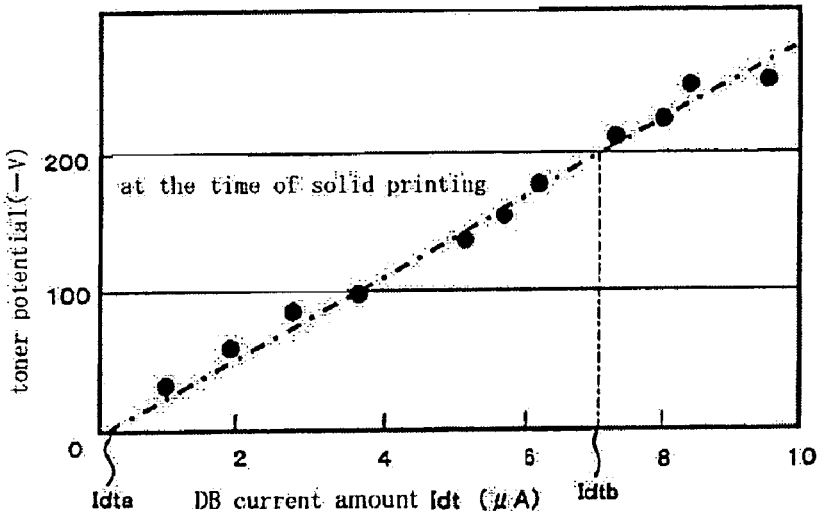
FIG. 8 is a view showing a relation between a DB current value and a toner potential.

Upon measuring the DB current in the above described way, the variation in the relation between the DB current and the toner potential as shown in FIG. 5 can be decreased as shown in FIG. 8. Therefore, the collinear approximation can be precisely made with the dashed line in FIG. 8.

That is, as shown in FIG. 8, under the condition that the relation between the DB current amount Idt and the toner potential Vt is approximated in a manner of the dashed line in FIG. 8 and the DB current amount at the time of the toner potential Vt equal to zero is expressed as Idta while the DB current vale at the time of the toner potential of 200 V is, for example, expressed as Idtb, the relation between the DB current amount Idt and the toner potential Vt is approximated according to the following expression.

$$Vt=200*(Idt-Idta)/(Idtb-Idta) \qquad \text{Expression2}$$

Since the above relational expression is satisfied, the toner potential Vt on the developing roller can be estimated upon measuring the DB current Idt.

Upon measuring the DB current Idt in a period between the timing Ta and the timing Tb in FIG. 6, the toner potential is determined as Vt according to the previously determined relational expression 2. It is to be noted that an average amount of the DB current may be set as the DB current Idt, in which the average amount is determined upon measuring the DB current several times in a period between the timing Ta and the timing Tb in FIG. 6.

The toner potential Vt is determined by substituting the measured DB current amount Idt in the expression 2 upon storing the Idta and the Idtb on the collinear approximation as well as the voltage corresponding to the Idtb, such as, e.g., 200V in this example, in a memory of the controlling unit 24. It is to be noted that the toner potential Vt corresponding to the DB current amount Idt may be retrieved upon storing previously the estimated toner potential in the memory of the controlling unit 24 for each DB current amount, not determined by the expression 2. Alternatively, although the calculation takes some time, the toner potential Vt can be estimated based on a relational expression determined with approximate upon dividing the relation between the DB current amount Idt and the toner potential Vt into a plurality of lines.

(Operation for Correcting Voltage Applied to Toner Supplying Roller)

Figure 9:
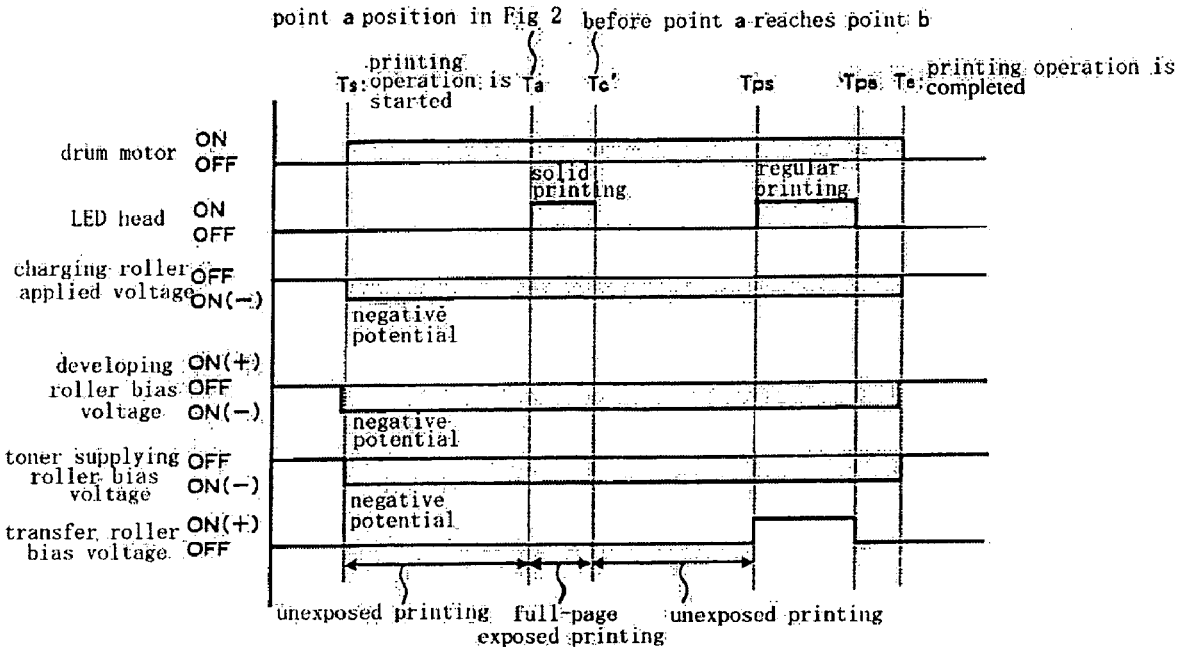
FIG. 9 is a time chart of a DB current measurement according to embodiments.
Figure 10:
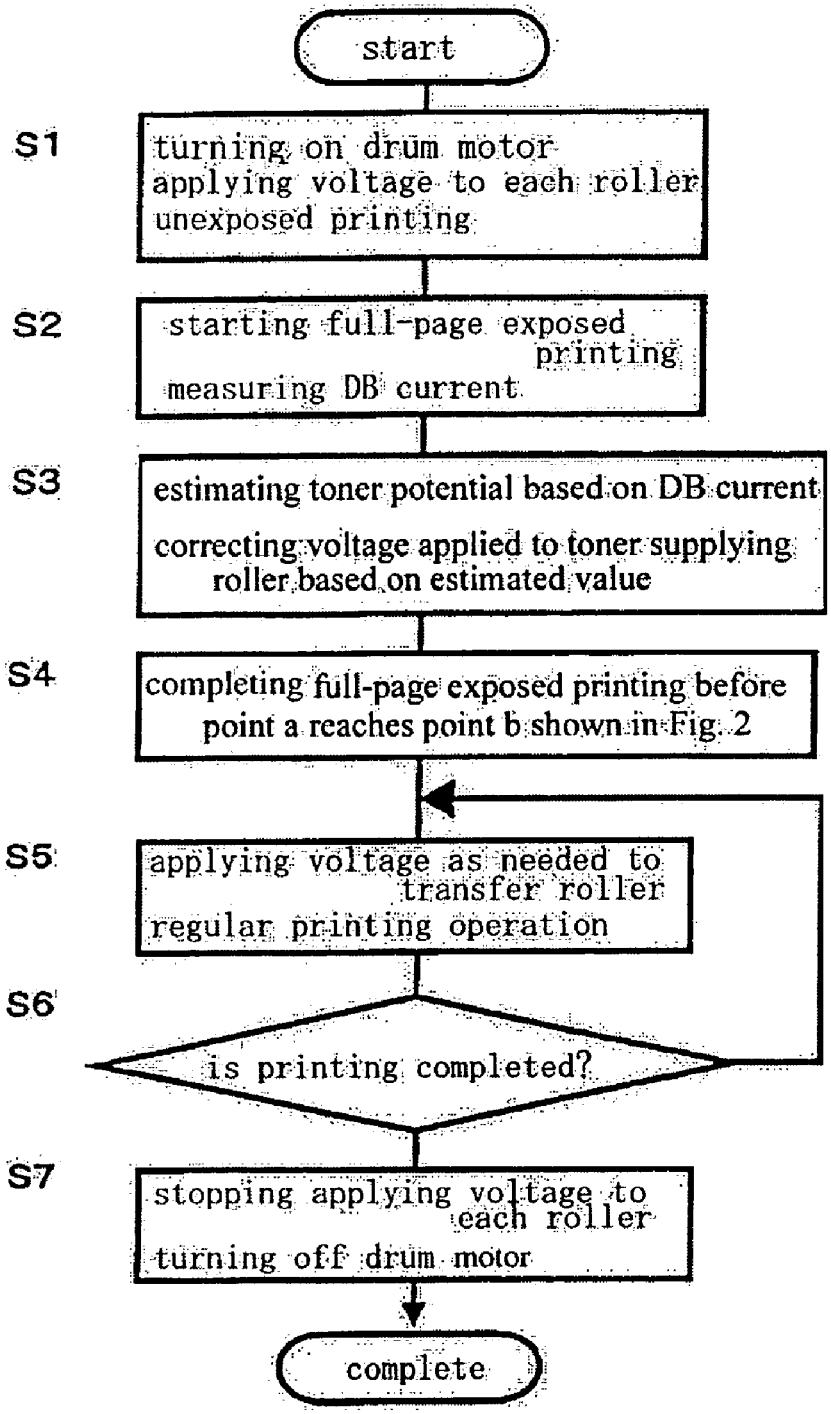
FIG. 10 is a flow chart showing operation of an image forming apparatus according to the first embodiment.

Operation for measuring the DB current is next explained in reference with a time chart in FIG. 9 and an operational flow chart in FIG. 10. First, when the printing operation is started where the a status on the image forming apparatus is shifted from, e.g., a power-on or a power saving mode to a regular mode, the controlling unit 24 implements the blank printing at the step S1 in the timing Ts for a prescribed period upon turning on a drum motor, not shown, upon applying a prescribed voltage to the developing roller 2 with the bias supply 16 through the voltage setting unit 27, and upon applying a prescribed voltage respectively to the charging roller 4 and the toner supplying roller 3 with the bias supplies 15, 17. It is to be noted that the toner layer needs to be formed entirely on the developing roller 2 with the blank printing, so that the blank printing is implemented in continuity for a period during which the developing roller 2 rotates at least once. Subsequently, the controlling unit 24 turns on the LED head 26 to start the solid printing, thereby measuring the DB current with the current measuring unit 28 at the step S2 in the timing Ta.

Furthermore, based on the measured DB current amount Idt, the toner potential Vt is determined with the expression 2, and based on the determined toner potential Vt, the voltage applied to the toner supplying roller 3 is corrected as follows at the step S3.

The bias voltage applied to the toner supplying roller 3 has a relation expressed by the following expressions, according to FIG. 4 showing the relation of the voltage of each unit.

$$Vd \text{ is nearly equal to } Vg+Vt+300\text{ V} \qquad \text{Expression 3}$$

$$Vt \text{ is nearly equal to } Vd-Vg-300\text{ V} \qquad \text{Expression 4}$$

Therefore, in a case of, e.g., the unexposed printing, where the photosensitive drum surface potential Vd is set to −800 V while the developing roller bias voltage Vg is set to −200 V, since the above expressions are described based on absolute values, the Vt is nearly equal to 800 V−200 V−300=300 V Thus, the toner supplying roller bias voltage Vs is to be corrected so that the voltage Vt determined based on the DB current amount Idt is of 300 V That is, a correction amount of the toner supplying roller bias voltage is determined by the following expression, thereby adding the determined correction amount to the current toner supplying roller bias voltage Vs.

$$\Delta Vs=300\ \text{V}-Vt \qquad \text{Expression 5}$$

For example, in a case of the toner potential of 100 V, ΔVs is equal to 200 V based on the expression 4, so that the current toner supplying roller bias voltage Vs is to be applied after added with 200 V.

The LED head 26 is turned off at the step S 4 in timing Tc' before the point at which the toner on the developing roller 2 hardly remains, i.e., the point a in FIG. 2, moves to reach the position of the point b in FIG. 2, and the full-page printing is then completed.

After a certain time period passes, the regular printing operation is started upon applying the fixed positive voltage to the transfer roller 5 at the step S5 in timing Tps, thereby operating the prescribed printing according to the printing data from the host apparatus 22.

Where the printing data is not transmitted from the host apparatus for a certain period, or where the printing operation is continued upon a judgment made at the step S6, as to whether an operator turned off a power button, the operation returns to the step S4 while where the completion of the printing operation is instructed, a control for completion of the printing operation is implemented at the step S6.

That is, based on the instruction for the power saving mode or for a power-off on the image forming apparatus, the voltage is stopped being applied to the transfer roller 5 and the developing roller 2 while the voltage is stopped being applied to the charging roller 4 and the toner supplying roller 3, and then the drum motor, not shown, is turned off to complete the printing operation in timing Te at the step S7.

According to the above described operation, the toner potential is estimated based on the DB current in the period between the timing Ta and the timing Tc', and the toner supplying bias voltage Vs is corrected base on the estimated toner potential, so that the appropriate toner supplying roller bias voltage Vs can be set, in which the printing neither gets soiled at the blank printed portion due to excessive increase in the toner supplying roller bias voltage Vs, nor becomes blurred due to excessive decrease in the toner supplying roller bias voltage Vs. It is to be noted that in a case of the DB current measurement, where the environmental condition changes over time, the DB current is desirably measured as immediately as possible prior to the printing.

Where the toner potential is estimated not upon the DB current only at the time of the full-page exposed printing in the period between the timing Ta and the timing Tc' as described above but in the way that the DB current amounts at the time of the unexposed printing as well as the above described full-page exposed printing are measured to determine a difference between the above DB current amounts as a DDB current and then the same relation as that in FIG. 8 between the DDB current and the toner potential is determined to measure the DDB current amount, e.g., before stat of the printing, the offset error at the current measuring unit 28, the error due to a temperature drift, or the like can be eliminated by the difference, so that the toner potential can be precisely estimated.

(Effect of First Embodiment)

According to the image forming apparatus in the first embodiment, the toner potential is to be estimated in the way that the DB current is measured at the time of the printing within a certain range from when the development starting point on the developing roller starts development to when the development starting point comes in contact with the toner supplying roller after the unexposed printing is operated to supply the toner to the entire developing roller, so that even where the amount of the toner layer formed on the developing roller changes due to, e.g., the change in the charging characteristic caused by the change in the environmental condition, the change over time, or each replacement to the EP cartridge, the toner supplying roller bias voltage can be corrected, and therefore an unexposed area not to be printed can be prevented to get soiled while the printing does not get blurred because of lowering of the toner concentration.

Second Embodiment

On the image forming apparatus according to the second embodiment, the DB current amount described in the first embodiment becomes less than a prescribed threshold amount, a warming-up processing is to be added. Herein, the warming-up processing means preparation operation for enabling the image forming apparatus to form images, in which the warming-up operation includes at least the operation for injecting an electric charge into the toner around the developing roller upon applying the prescribed voltage to the developing roller. Other than the above operation, the warming-up operation may include, in some cases, the processing for cleaning up the photosensitive drum or for warming up the fusing unit.

(Structure)

The structure of the image forming apparatus according to the second embodiment is the same as that of the first embodiment, so that the corresponding explanation is omitted for the sake of simplification.

(Operation)

In a case of the DB current amount of less than a certain amount, the electric charge flows out of the toner upon left under the environment such as, e.g., high humidity, for a long time, thereby regularly decreasing in most cases, and in this case, the printing cannot be implemented in a good condition even where the voltage of the toner supplying roller bias voltage or the like is rendered to increase. Therefore, on the image forming apparatus according to the second embodiment, in a case where the DB current measured likewise the first embodiment is less than a prescribed threshold amount, a judgment is made that the toner is in the above status, so that the warming-up processing is added to inject the electric charge into the toner, thereby operating the regular charging.

Figure 11:
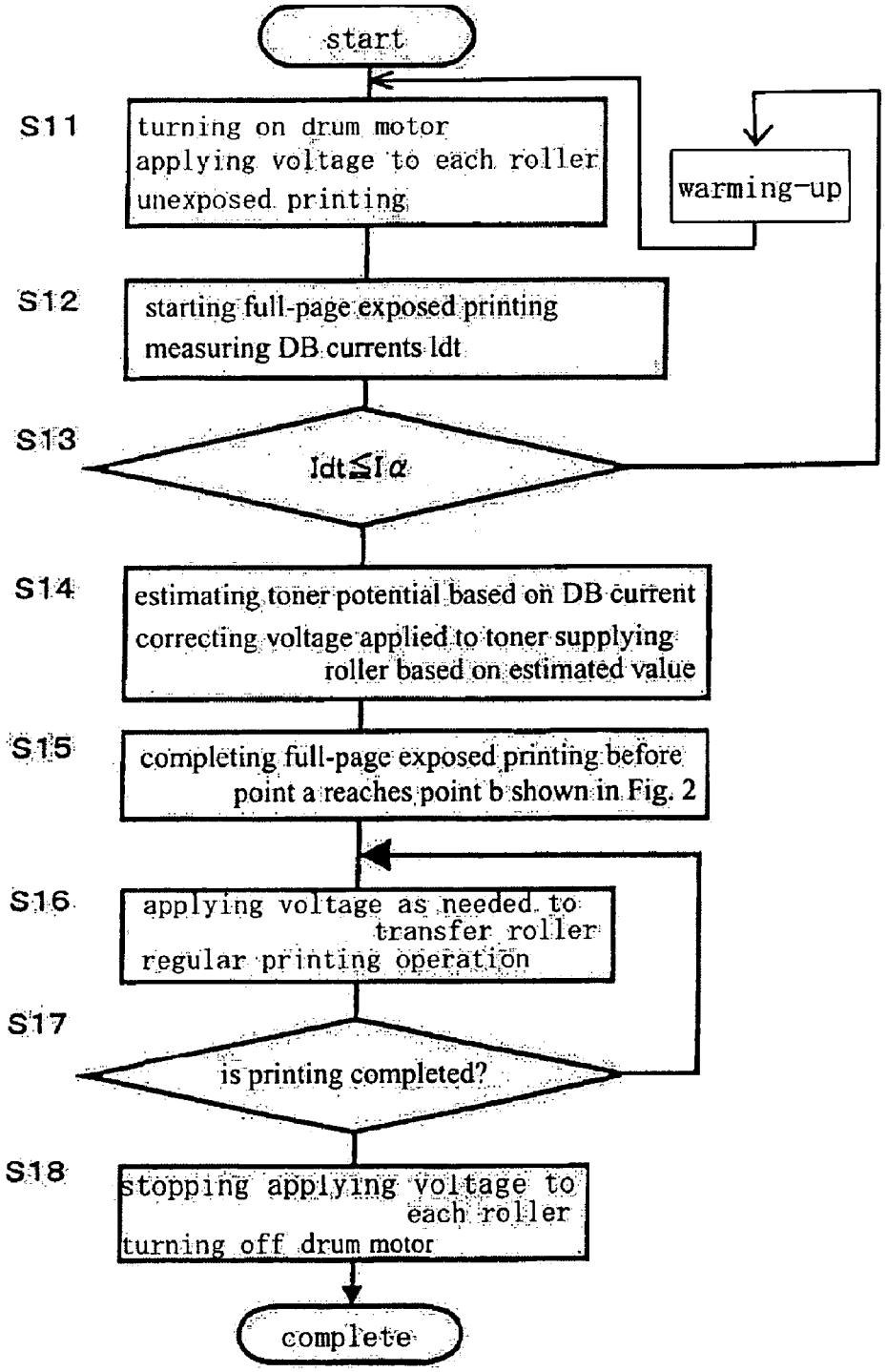
FIG. 11 is a flow chart showing operation of an image forming apparatus according to the second embodiment.

Operation of the image forming apparatus according to the second embodiment is explained in detail in reference with a flow chart in FIG. 11. It is to be noted that the steps S11, S12, and S14 to S18 are the same as the steps S1, S2, and S3 to S7, in FIG. 10 described in the first embodiment, so that the detailed explanation for these steps are omitted for the sake of simplification.

First, when the printing operation is started, the controlling unit 24 turns on the drum motor, not shown, while applying the prescribed voltage to each roller with the bias supply through the bias supply to start the blank printing at the step S11, thereby turning on the LED head 26 after a certain period to start the solid printing, and thereafter the DB current is measured with the current measuring unit 28 at the step S12.

According to the measured DB current amount Idt, a judgment is made at the step S13 as to whether the warming-up operation is necessary based on the current amount Ia determined previously with an experiment. In a case of the DB current amount Idt of less than Ia, the DB current is measured again at the step S12 after the blank printing operation at the step S11 after the warming-up operation at the step S19 for a prescribed time period, and the same judgment is made at the step S13. On the other hand, in a case of the DB current amount Idt of greater than Ia, a judgment is made that the sufficient electric charge is injected into the toner, and then the operation goes to the step S14.

The toner potential Vt is determined by the expression 2 based on the measured DB current amount Idt, and the voltage Vs applied to the toner supplying roller 3 is corrected at the step S14, likewise the step S3 in the first embodiment, based on the determined toner potential Vt.

The LED head 26 is turned off in timing before the point at which the toner on the developing roller 2 hardly remains, i.e., the point a in FIG. 2, moves to reach the position of the point b in FIG. 2, and the full-page printing is completed at the step S15.

After a certain period, the regular printing operation is started upon applying the fixed positive voltage to the transfer roller 5, thereby operating the prescribed printing at the step S16 according to the printing data transmitted from the host apparatus 22.

Where the printing data is not transmitted from the host apparatus 22 for a certain time period, or where the printing operation is continued upon a judgment made at the step S17, as to whether the operator turned off a power button, the operation returns to the step S16 while where the completion of the printing operation is instructed, a control for completion of the printing operation is implemented at the step S18.

According to the above operation, in a case of the DB current amount Idt of less than a fixed current amount Ia, a judgment is made that the electric charge is not injected sufficiently, and the correction with the DB current is to be made after the warming-up operation is implemented for a certain period to inject the prescribed charge into the toner near the developing roller, so that in a case of the toner in the status beyond the range correctable with the DB current, the toner potential can be estimated appropriately without operating the estimation of the toner potential, thereby being able to correct the toner supplying roller bias voltage Vs based on the estimated toner potential.

The above description for the second embodiment explains that where the DB current measured at the step S13 is less than the fixed amount Ia, the operation returns to the step S11, but the operation at the step S11 can be omitted where the developing roller during the warming-up operation goes into the same status as that during the exposed printing.

It is to be noted that the unexposed printing may be operated for a certain period as the warming-up processing, and the electric charging is injectable into the toner in this case as well. Furthermore, since the threshold amount of the above Ia changes depending on models of different structures and members' material of the apparatus, it is desirable to determine previously the most appropriate amount with an experiment and to store the determined amount in, e.g., the memory unit of the controlling unit 24. Alternatively, the standard amount Ia changes depending on, e.g., the temperature and humidity inside the apparatus as well, it is desirable to detect the temperature and humidity inside the apparatus, especially, near the toner, and correct the amount according to the detected temperature and humidity.

Furthermore, the above description for the second embodiment explains that the certain period for warming up the apparatus is to be set in a case of the DB current amount of less than the fixed amount Ia, but since such a warming-up period is more needed when the DB current amount is less, the warming-up period may be changed according to the DB current amount in a case of the DB current amount of less than the fixed amount Ia.

(Effect Of Second Embodiment)

As described above in detail, according to the image forming apparatus according to the second embodiment, in a case of the measured DB current of less than the fixed amount, the warming-up processing is to be added, so that in a case of the toner in the status beyond the scope correctable with the DB current, after the injection of the fixed electric charge, the toner potential is estimated in the status where the toner is within the correctable scope, and the toner supplying roller bias voltage Vs is correctable according to the estimated toner potential.

Third Embodiment

The image forming apparatus according to the third embodiment has the means for detecting a toner supplement upon detection of the remaining toner amount, in which the warming-up period before the operation of the DB current measurement is changed when a judgment is made that the toner is supplemented.

(Structure)

Figure 12:
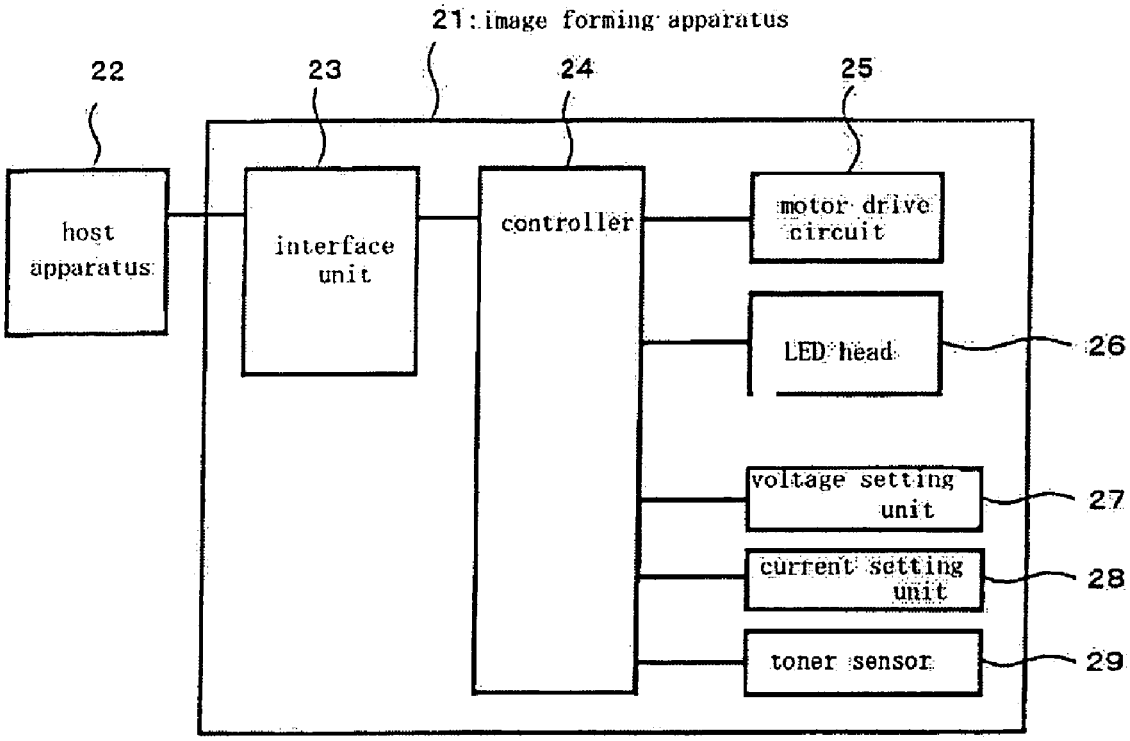
FIG. 12 is a view showing a structure of a control system according to the third embodiment and the fourth embodiment.

A structure of the control system of the image forming apparatus according to the third embodiment is such that a toner sensor 29 for detecting the remaining toner amount is newly installed, as shown in FIG. 12, to the control system of the image forming apparatus according to the first embodiment. Other than the above, the structure is the same as that according to the first embodiment, so that the detailed corresponding explanation is omitted for the sake of simplification. Furthermore, the structure of the image forming apparatus according to the third embodiment is the same as that according to the first embodiment other than the means for detecting the toner remaining amount, so that the detailed corresponding explanation is omitted for the sake of simplification.

Figure 13:
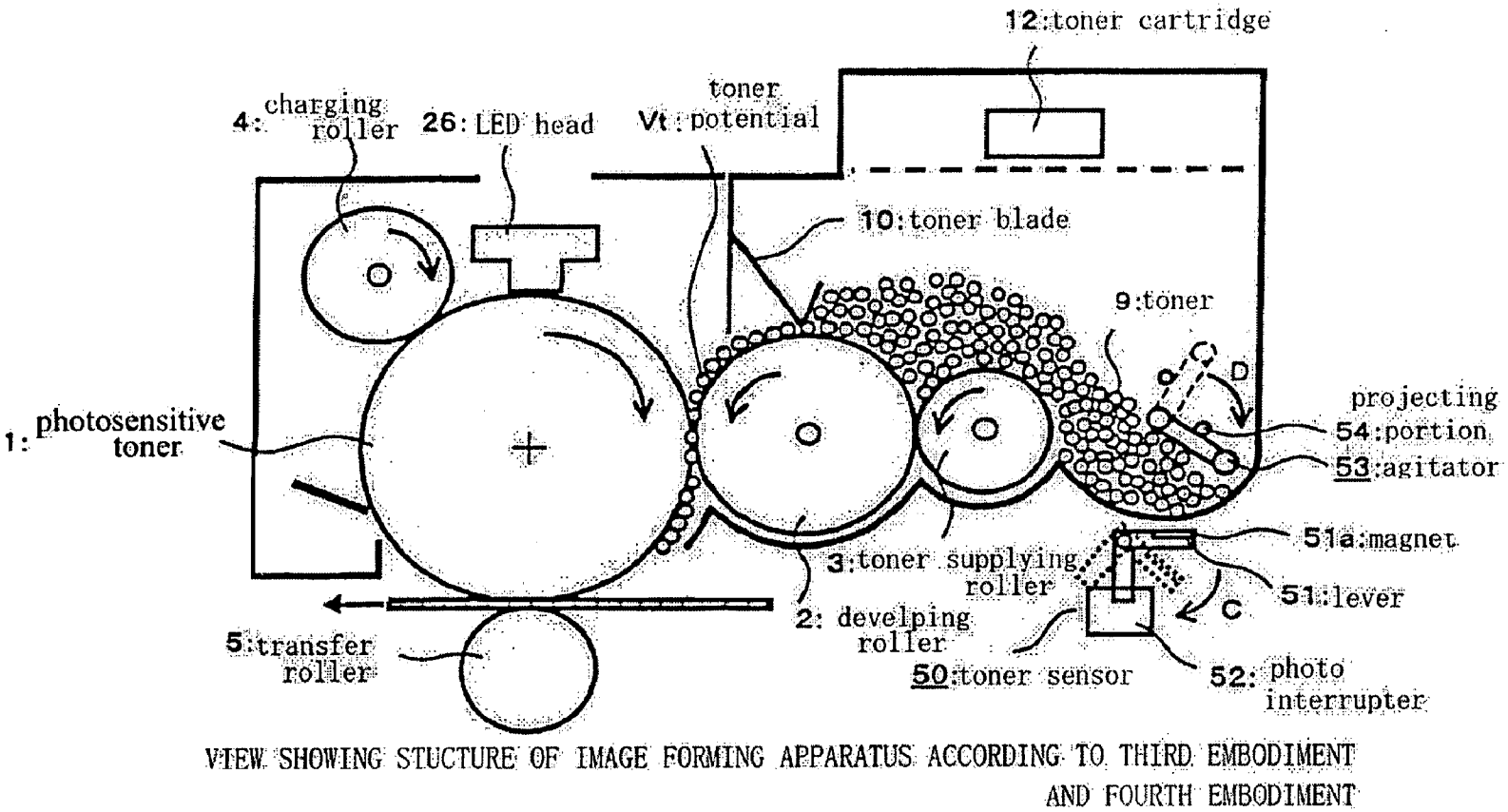
FIG. 13 is a view showing a structure of an image forming apparatus according to the third embodiment and the fourth embodiment.
Figure 14:
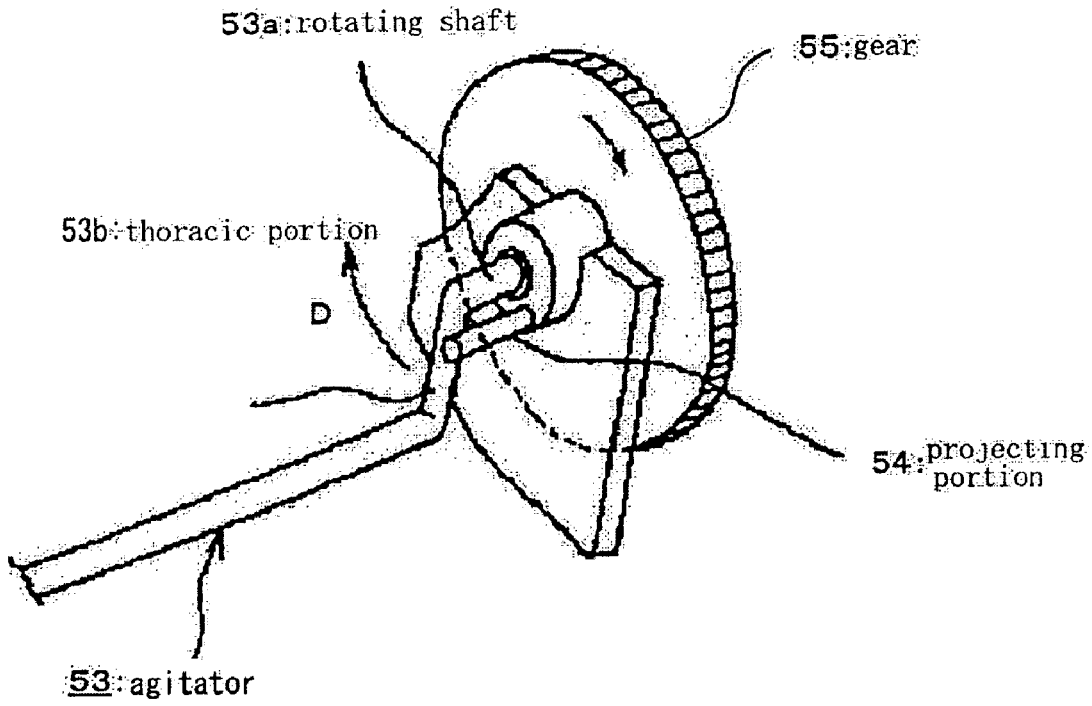
FIG. 14 is a view showing a structure of an agitator according to the third and the fourth embodiment.

First, a toner sensor 50 for detecting the remaining toner amount is explained in reference with FIG. 13 (lower right) and FIG. 14. The toner sensor 50 has a structure in which a magnet 51*a* is arranged to a front end of a lever 51 having a rear end intersecting at a photointerrupter 52, in which the lever 51 is energized in direction C with, e.g., springs or like.

On the other hand, a rotating shaft 53*a* of an agitator 53 for agitating the toner has a structure, in which the rotating shaft 53*a* is inserted into a center portion of a gear 55 but supported independently from a gear 55 and rendered rotatable upon engaged with the gear 55 in one direction. That is, where the gear 55 rotates in direction D, a projecting portion 54 presses and rotate a thoracic portion 53*b* of the agitator 13 in the direction D. Furthermore, a part of the thoracic portion 53*b* is made of a magnetic material to be attracted to the magnet to detect the toner remaining amount described hereinafter.

With the above described structure, when the thoracic portion 53*b* comes down to a lower side, the lever 51 is attracted in a direction opposite to the direction C because of the magnet 51*a* installed to the lever 51, thereby being moved to a position indicated by a full line in FIG. 13 to interrupt the photointerrupter 52. Furthermore, in the status where the thoracic portion 53*b* is neither positioned at the lower side nor attracted to the magnet 51*a* installed to the lever 51, since not attracted with the magnet 51*a*, the lever 51 is rotated in a direction C with, e.g., the springs or the like, thereby being located at a position indicated by a dotted line in FIG. 13, so that the photointerrupter 52 is not interrupted.

(Method for Detecting Remaining Toner Amount)

Figure 15:
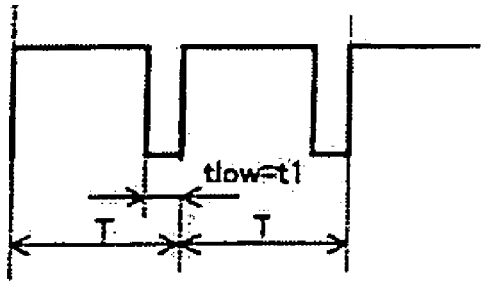
FIG. 15 is an output signal of a photo-interrupter according to the third embodiment and the fourth embodiment.
Figure 15:
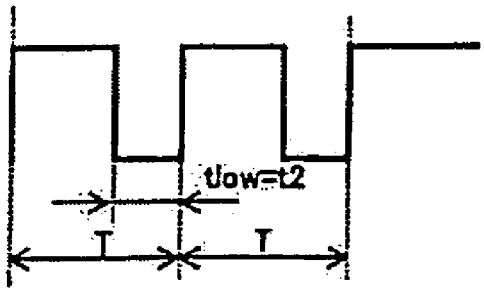

With the above described structure, the remaining toner of the image forming apparatus according to the third embodiment is detected in the following manner. That is, where the toner remains sufficiently, the thoracic portion 53*b* receives the resistance of the toner at all times to rotate at a certain speed without separating from the projecting portion 54. In this case, an output waveform of the photointerrupter 52 becomes such as indicated by (a) in FIG. 15, and where a rotation period of the gear 55 is set to T, an attracting period tlow of the magnet 51*a* shortens down to t1.

On the other hand, where the remaining toner amount reduces to about half amount, since there is no resistance of the toner adding onto the thoracic portion 53*b* when the thoracic portion 53*b* passes over an upper portion, the thoracic portion 53*b* separates for its own weight from the projecting portion 54 to fall dawn to the toner surface, so that the period during which the thoracic portion 53*b* positions at the lower side becomes longer. Thus, the attracting period tlow of the magnet 51*a* results in t2 longer than t1.

The toner remaining amount is estimated upon estimating the attracting time tlow of the magnet 51*a* according to previously determined a relation between the toner remaining amount and the attracting period tlow of the magnet 51*a*, and where the period tlow becomes longer than the certain period ta, the toner is judged as lacking.

(Bias Voltage Correcting Processing Based on DB Current)

On the image forming apparatus according to the third embodiment, a processing for correcting the bias voltage of the toner supplying roller based on the DB current, accompanying a processing for judging the remaining toner amount, is made where a cover of the apparatus is opened or closed every time when printing one page of paper is started or completed, or when the toner is supplemented or the EP cartridge 13 is replaced. This processing is explained in reference with a flow chart in FIG. 6.

First, the contents of register TSnew is transferred into register TSold to keep a result of a new judgment for a lack of toner, described hereinafter, and the remaining toner amount, i.e., the attracting period tlow of the magnet 51*a* is measured at the step S20, and then a judgment is made at the step S21 as to whether the remaining toner amount is lacking depending on whether the period tlow is longer than the certain period ta.

Where the period tlow is longer than the certain period ta, the toner amount is judged as lacking, and "zero" for expressing the lacking status is set on the register TSnew. Subsequently, "one" is added to a lacking toner counter value Nx at the step S23, and an alarm notification is displayed to notify the operator of a lack of toner at the step S24.

A judgment is then made at the step S25 as to whether the lacking toner counter value Nx is greater than a fixed amount Na, and where the counter value Nx is greater than the fixed amount the printing is canceled and this processing is completed at the step S26 even where the printing data from the host apparatus is received from the host apparatus since the remaining toner amount lacking status continues and thus there is a risk that the regular printing cannot be implemented. On the other hand, where the lacking toner counter value Nx is less than the fixed amount Na, the printing is still implementable, so that the operation goes to the step S27.

In the meantime, although it is not described in this flow chart for this operation, where the toner cartridge 12 or the EP cartridge 13 is replaced, the bias voltage of the toner supplying roller needs to be corrected upon the measurement of the DB current, so that the replacement of the toner cartridge is detected upon detecting the opening and closing of the apparatus cover, and where the replacement of the toner cartridge is detected, "one" is to be set on DB current measuring flag DSF.

At the step S27, an amount of the flag DSF is read to make a judgment as to whether the bias voltage is to be corrected based on the DB current, and where "one" is set on the DB current measuring flag DSF, the processing for correcting the bias voltage of the toner supplying roller based on the DB current measurement is made at the step S28, and the DB current measuring flag DSF is reset, i.e., set to "zero", thereby completing this processing at the step S29.

Where the DB current measuring flag DSF is set to "zero", the processing at the step S28, for correcting the bias voltage of the toner supplying roller based on the DB current measurement is skipped, and the operation goes to the next step, i.e., the step S29. It is to be noted that processing at the step S28, for correcting the bias voltage of the toner supplying roller based on the DB current measurement is the same as these at the steps S1 to S4 in FIG. 10 according to the first embodiment or at the steps S11 to S15 and S19 according to the second embodiment, so that the corresponding explanation is omitted for the sake of simplification.

On the other hand, the attracting period tlow is less than the certain period ta at the step S21, a judgment is made that the toner amount is sufficient, so that "one" for expressing that the toner is not lacking is set on the register TSnew at the step S30. Subsequently, since the toner is sufficient, the lacking toner couter amount Nx is reset and "zero" is loaded at the step S31.

A judgment is then made at the step S32 as to whether the amount shifted to the register TSold, set as the TSnew at the step S20 in previous processing, is "zero" or not. Where the amount of the register TSold is set to "one", a judgment is made that the sufficient remaining toner amount is detected on the previous detection and there is no change in that remaining toner amount, so that the operation goes to the step S27 to make a judgment as to whether the bias voltage is to be corrected based on the DB current, thereby making the subsequent same operation as described above.

On the other hand, where the amount of the register TSold set to "zero", the small amount remaining toner is detected on the previous detection while the increased amount of remaining toner is detected on this time's detection, that is, it means that the toner is supplemented. In this case, since the electric charge needs to be injected to measure the precise DB current, where a judgment is made at the step S33 that the DB current measuring flag DSF is set to "one" and the DB current measurement is judged as necessary, the warming-up processing is made and the certain electric charge is injected at the step S34. Where the DB current measuring flag DSF is set to "zero", the bias voltage does not need to be corrected based on the DB current, so that the operation goes to the step S29 and the DB current measuring flag DSF is cleared.

Subsequently, the DB current is measured at the step S28 as described above to make the operation for correcting the bias voltage of the toner supplying roller, and the DB current measuring flag DSF is reset to complete this processing at the step S29.

It is to be noted that the processing for making a judgment at the step S27 and the step S33 as to whether the DB current measurement needs to be made every time when the toner is supplemented or when the EP cartridge is replaced, so that this processing described above becomes unnecessary. However, other than this case, this processing is made every time when printing one page of paper is started or completed, so that the processing for making the above judgment is to be made.

The above description for the third embodiment explains that the warming-up processing is to be made for a prescribed period when the increase is detected in the remaining toner amount, but the period for the warming-up processing may be changed according to the increased amount of remaining toner detected upon the detection of the amount of the supplemented toner, i.e., the increased amount of remaining toner.

(Effect Of Third Embodiment)

As described above in detail, according to the image forming apparatus in the third embodiment, where the toner is judged as supplemented upon the detection of the toner remaining amount, the prescribed warming-up processing is to be made before the DB current measurement, so that the toner potential can be precisely estimated based on the DB current, thereby being able to correct accurately the toner supplying roller bias voltage Vs.

Fourth Embodiment

The image forming apparatus according to the fourth embodiment has the means for detecting the supplement of the toner upon detecting the remaining toner amount, in which the bias voltage applied to the toner supplying roller, set based on the DB current, is to be corrected where the toner is judged as supplemented.

(Structure)

The structures of the image forming apparatus, the control system, and the toner sensor according to the fourth embodiment are the same as those according to the third embodiment, so that the corresponding explanation is omitted for the sake of simplification.

(Bias Voltage Correcting Processing Based on DB Current)

Figure 16:
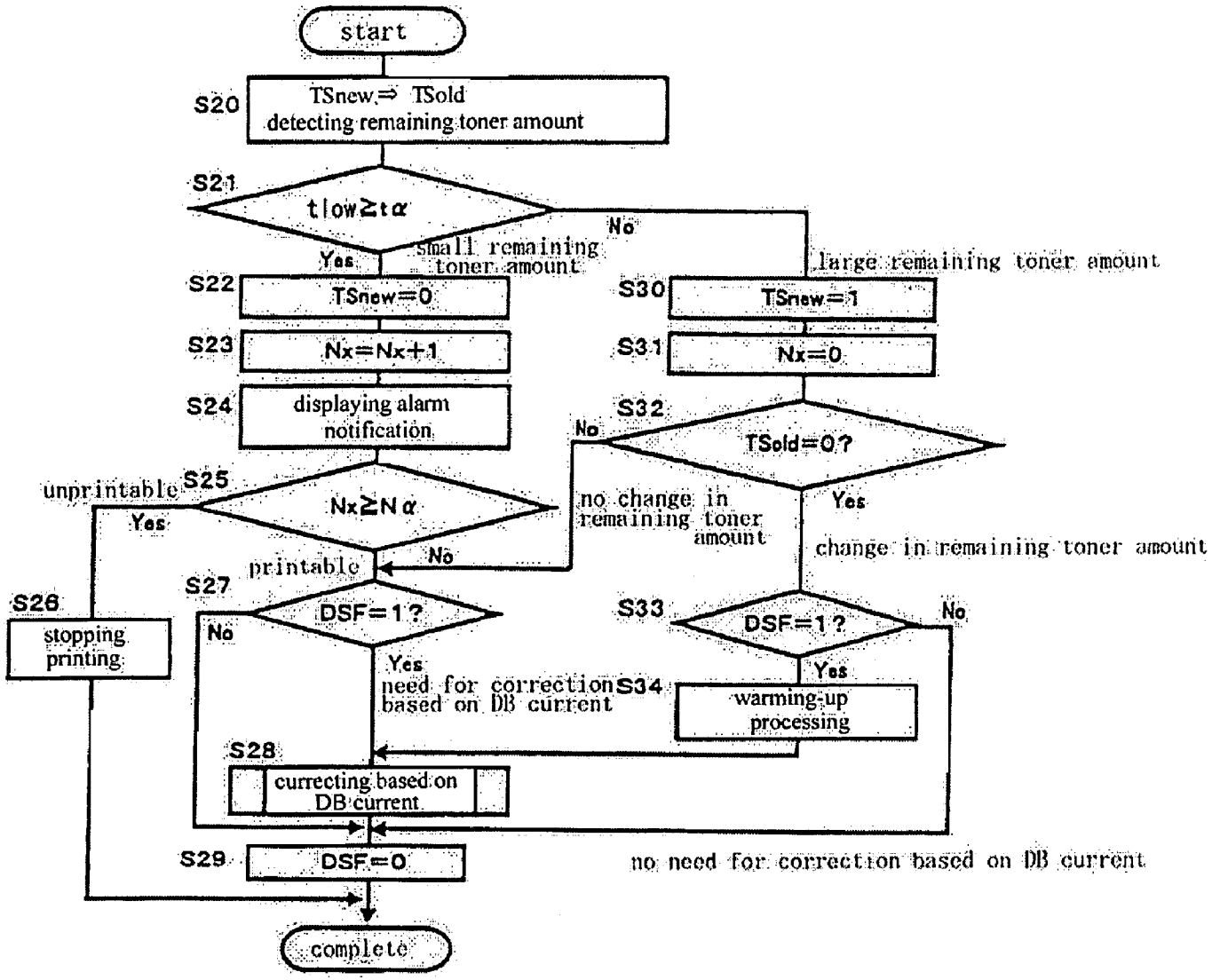
FIG. 16 is a flow chart showing operation of an image forming apparatus according to the third embodiment.
Figure 17:
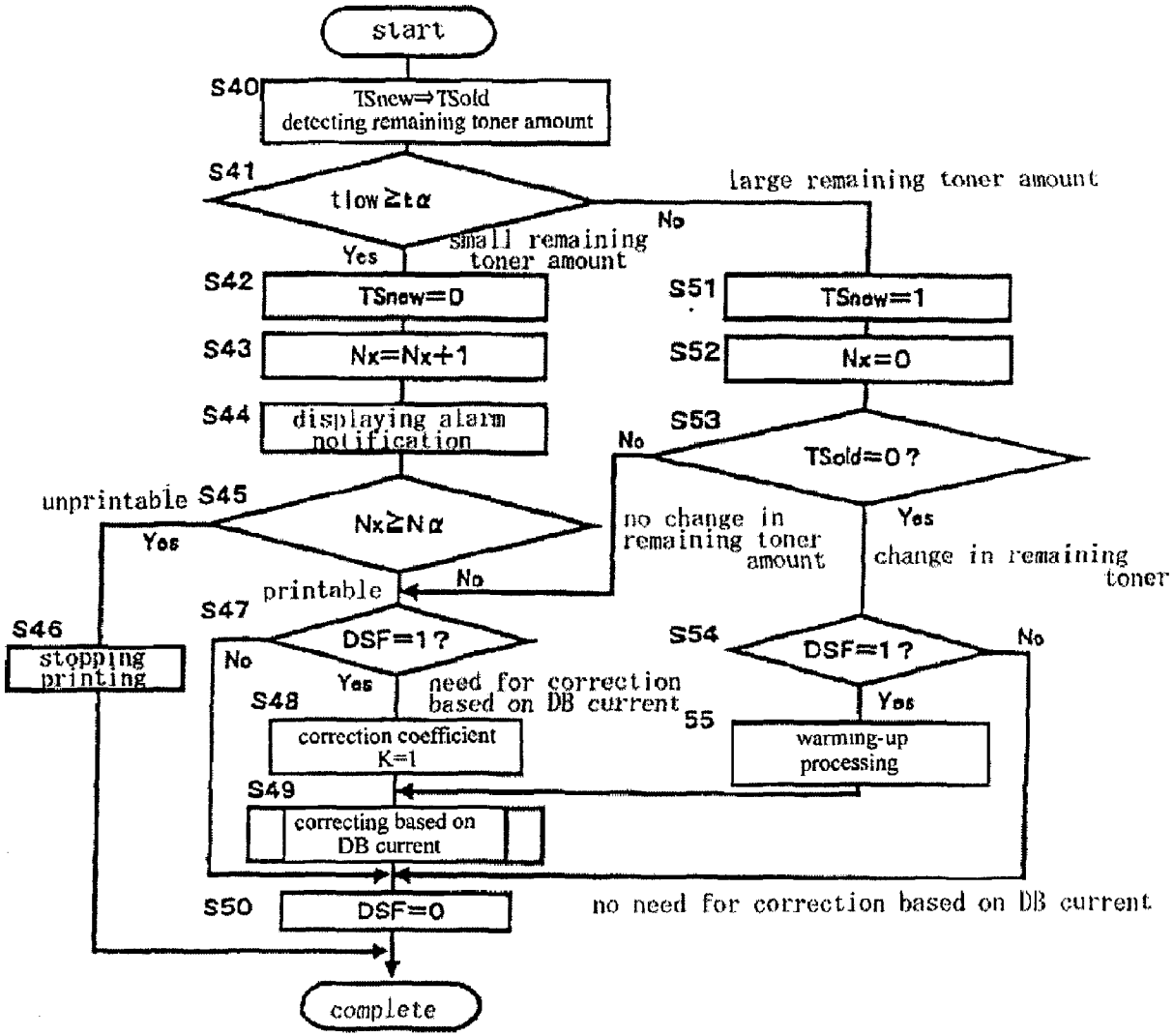
FIG. 17 is a flow chart showing operation of an image forming apparatus according to the fourth embodiment.
Figure 18:
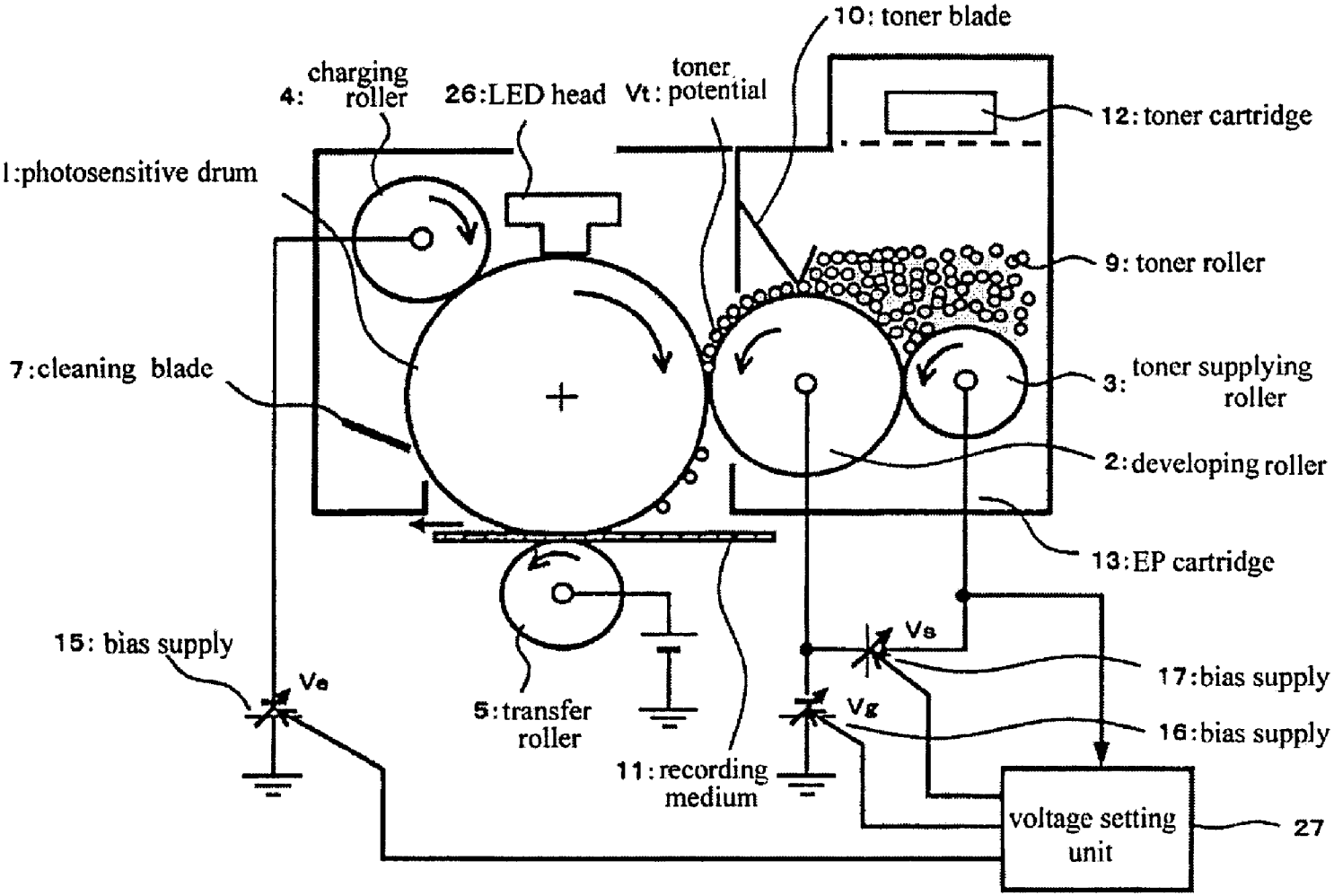
FIG. 18 is a view showing a structure of a conventional image forming apparatus.

With the above described structure, the processing for correcting the bias voltage based on the DB current is operated as follows on the image forming apparatus according to the fourth embodiment. This operation is explained in reference with a flow chart for the operation in FIG. 17. It is to be noted that the processing for detecting the remaining toner amount is the same as that according to the third embodiment, and in this processing, the step S40 to the step S47 and the step S49 to the step S54 shown in FIG. 17 are the same as the S20 to the step S27 and the step S28 to the step S33 shown in FIG. 16, so that the detailed corresponding explanation is omitted for the sake of simplification.

It is the same as the third embodiment that the processing for correcting the bias voltage of the toner supplying roller based on the DB current, accompanying the processing for judging the remaining toner amount, is made where a cover of the apparatus is opened or closed every time when printing one page of paper is started or completed, or when the toner is supplemented or the EP cartridge 13 is replaced.

First, after sifting the previous result of a judgment as to the toner amount, i.e., the contents of the register TSnew, to the register TSold, a judgment is made as to whether the remaining toner amount is lacking upon measuring the attracting period tlow. Where the toner is judged as lacking, "zero" is set on the register TSnew, "one" is added to the lacking toner counter value Nx, and the alarm notification is displayed to notify the operator of a lack of the toner.

Where the lacking toner counter value Nx is greater than the fixed amount Na, the printing is canceled while where the lacking toner counter value Nx is less than the fixed amount Na, the amount on the DB current measuring flag DSF is read to make a judgment as to whether the bias voltage is to be corrected based on the DB current at the step S40 to the step S47.

Where "one" is set on the DB current measuring flag DSF, "one" is set to correction coefficient Kat the step S48, and the DB current measuring flag DSF is reset at the step S50 after the bias voltage of the toner supplying roller is corrected based on the toner supplying roller at the step S49.

Herein the correction coefficient K is defined a coefficient at the time when the bias voltage Vs of the toner supplying roller is corrected with the expression 5, using the toner potential Vt estimated based on the DB current with the expression 2 using the relation shown in FIG. 8, and such correction coefficient K is used in the following expression.

$$\Delta Vs = K^*\{300\ \mathrm{V} - Vt\} \qquad \text{Expression 6}$$

On this correction coefficient K, in a case, e.g., where the toner is newly supplemented, the bias voltage applied to the toner supplying roller needs to be decreased even where the small DB current, i.e., the small toner potential, is estimated. This is because that the newly supplemented toner has a good charging characteristic since not damaged upon, e.g., agitated inside the developing unit, or since prevented from getting moist upon packed to absorb the small moisture amount. At the step S48, since in a status where the toner amount does not change in particular, the correction coefficient K is set to one to satisfy the expression 5.

It is to be noted that the processing at the step S49, for correcting the bias voltage of the toner supplying roller upon the DB current measurement is the same, other than the correction based on the correction coefficient K, as that according to the third embodiment, so that corresponding explanation is omitted for the sake of simplification.

On the other hand, where the toner amount is judged as sufficient at the step S41, "one" is set on the register TSnew, the lacking toner counter value Nx is reset, and the register TSold is referred to as the previous detection result of the remaining toner amount. Where the amount of the register TSold is set to "one", and the judgment is made that the sufficient toner amount is detected on the previous detection for the remaining toner amount, and no change is detected in the remaining toner amount, the operation goes to the step S47 and the subsequent operation at the step S51, the step S52, and the step S53 are made in the same way.

On the other hand, the amount of the register TSold is set to "zero", the small amount remaining toner is detected on the previous detection for the remaining toner amount while the increased amount of remaining toner is detected on this time's detection, that is, it means that the toner is supplemented. In this case, the correction on the expression 5 is necessary as described above, so that where the DB current measuring flag DSF is set to "one" and the DB current measurement is judged as necessary at the step S54, the correction coefficient K is set to ka at the step S55. Normally, the correction coefficient ka is desirably set to approximately between 0.6 to 0.8 less than 1, however, the appropriate amount is desirably determined for each model upon experiments since the correction coefficient ka changes depending on the structure and each member material of the apparatus.

Subsequently, the bias voltage of the toner supplying roller is corrected with the expression 6 at the step S49, and the DB current measuring flag DSF is cleared to complete this processing.

It is to be noted that the processing for making a judgment as to whether the DB current measurement at the step S47 and the step S54 is to be operated, needs to be made every time when the toner is supplemented or when the EP cartridge 13 is replaced, so that this processing described above becomes unnecessary. However, other than this case, this processing is made every time when printing one page of paper is started or completed, so that it is the same as the third embodiment that the processing for making the above judgment is to be made.

The above description for the fourth embodiment explains that the bias current set upon corrected based on DB current is to be further corrected where the increased amount of remaining toner is detected, but the correction amount may be changed according to the increased amount of remaining toner detected upon the detection of the amount of the supplemented toner, i.e., the increased amount of remaining toner.

(Effect Of Fourth Embodiment)

As described above in detail, according to the image forming apparatus in the fourth embodiment, where the remaining toner amount is detected and the toner is judged as supplemented, the bias voltage set upon corrected based on the DB current is to be further corrected according to the increased amount of remaining toner, so that the toner supplying roller bias voltage Vs can be corrected without rendering the period up to the first printing longer because of the warming-up processing.

(Other Modifications)

Other than the above described embodiments, the same actions and effects of this invention can be obtained according to the following modifications.

(1) The above description for the image forming apparatus according to the embodiments shows an example in which the bias voltage Vs of the toner supplying roller 3 is corrected based on the toner potential estimated based on the DB current amount. However, since the sift of the toner 9 to the photosensitive drum 1 is determined upon a correlation between the toner potential and the surface potential Vd of the photosensitive drum mainly determined with the bias voltage of the developing roller 2 or the toner supplying roller 3, the bias voltage Ve of the charging roller 4, determining the surface potential Vd of the photosensitive drum or the bias voltage Vg of the developing roller 2, determining the toner potential may be corrected.

(2) The above description for the image forming apparatus according to the embodiments explains that the solid printing is operated during the period from the timing Ta to the timing Tb in FIG. 6 to measure the DB current, however, the solid printing may be operated subsequently after the timing Tb, and the DB current may be measured during the period from the timing Ta to the timing Tb or, although the DB current amount decreases, the DB current may be measured during the period from the timing Tb to the timing Tc to estimate the toner potential.

(3) The above explanation for the image forming apparatus according to the first embodiment and the second embodiment shows an example, in which the bias voltage of the toner supplying roller is corrected upon measuring the DB current at the time that the a status on the apparatus is shifted from, e.g., a power-on or a power saving mode to a regular mode. However the bias voltage of the toner supplying roller may be corrected before the apparatus is shipped or after the EP cartridge 13 is replaced. Furthermore, the bias voltage of the toner supplying roller may be corrected at the time such as, e.g., every time when one page of paper is printed after the power is turned on, or at certain time intervals, or after the toner is replaced.

(4) The above description for the image forming apparatus according to the embodiments explains that the bias voltage of the toner supplying roller 3 or the like is to be corrected based on the DB current at the time of the full-page exposed printing, however, although the apparatus life or accuracy of the estimation little deteriorates, the bias voltage of each roller may be corrected based on the DB current at the time of the partial solid printing, not of the full-page exposed printing.

As described above, this invention can be applicable to the image forming apparatus such as, e.g., a printer, a facsimile machine, an electrophotographic apparatus, a photocopier, or the like.

The foregoing description of preferred embodiments of the invention has been presented for purposes of illustration and description, and is not intended to be exhaustive or to limit the invention to the precise form disclosed. The description was selected to best explain the principles of the invention and their practical application to enable others skilled in the art to best utilize the invention in various embodiments and various modifications as are suited to the particular use contemplated. It is intended that the scope of the invention should not be limited by the specification, but be defined by the claims set forth below.

What is claimed is:

1. An image forming apparatus comprising:

an image carrier charged upon application of a first voltage;

an exposure unit for forming an electrostatic latent image on said charged image carrier;

a developing member for developing, upon application of a second voltage, a developer corresponding to said electrostatic latent image formed on said image carrier;

a developer supplying member for supplying said developer to said developing member upon application of a third voltage;

a developing current detecting unit for measuring a current amount flowing through said developing member;

a development controller for controlling a developing process in a manner to apply said voltage to each member substantially without implementing exposure operation with said exposure unit for a first prescribed period and subsequently to implement development operation upon implementing said exposure operation with said exposure unit for a second prescribed period; and a voltage setting unit for adjusting said voltage to be applied to at least one of said members based on said current amount detected with said current detecting unit during said development operation.

2. The image forming apparatus according to claim 1, wherein said second prescribed period is defined within a period from a time that said exposure unit starts exposure to a time that a developed area of said developing member reaches said developer supplying member.

3. The image forming apparatus according to claim 1, wherein said first prescribed period is defined longer than a period during which an undeveloped area is formed entirely onto said developing member.

4. The image forming apparatus according to claim 1, wherein said voltage setting unit calculates a toner potential on said developing member based on said current amount of said current detecting unit during said development operation, and thereafter adjusts an applied voltage based on said calculated toner potential.

5. The image forming apparatus according to claim 4, wherein said toner potential on said developing member is calculated from an expression indicating a relation between said current amount of said current detecting unit during said development operation and a potential of said developer provided on said developing member and upon said current amount detected with said current detecting unit during said development operation.

6. The image forming apparatus according to claim 1, wherein an electric charge injection processing for supplying an electric charge to said developer is made based on said current amount detected with said current detecting unit.

7. The image forming apparatus according to claim 6, wherein said electric charge injection processing is defined as operation for applying said voltage to said image carrier, said developing member, and said developer supplying member upon entering said exposure unit in the substantially suspended status.

8. The image forming apparatus according to claim 1, further comprising a developer container for containing said developer, and a developer amount detecting unit for detecting a developer amount inside said developer container, wherein said image forming apparatus implements an electric charge injection processing for supplying an electric charge to said developer based on the developer amount detected with said developer amount detecting unit.

9. The image forming apparatus according to claim 1, further comprising a developer container for containing said developer, and a developer amount detecting unit for detecting a developer amount inside said developer container, wherein said image forming apparatus implements an electric charge injection processing for supplying an electric charge to said developer according to an increased amount of said developer detected with said developer amount detecting unit.

10. The image forming apparatus according to claim 9, wherein said electric charge injection processing changes the processing period according to said increased amount of said developer detected with said developer amount detecting unit.

11. The image forming apparatus according to claim 1, further comprising a developer container for containing said developer, and a developer amount detecting unit for detecting a developing amount inside said developer container, wherein said voltage setting unit adjusts said voltage to be applied to at least one of said members based on said developer amount detected with said developer amount detecting unit in addition to said current amount detected with said current detecting unit.

12. The image forming apparatus according to claim 1, further comprising a developer container for containing said developer, and a developer amount detecting unit for detecting a developing amount inside said developer container, wherein said voltage setting unit adjusts said voltage to be applied to at least one of said members based on an increased amount of said developer detected with said developer amount detecting unit in addition to said current amount detected with said current detecting unit.

* * * * *